US005553973A

United States Patent [19]

Duran

[11] Patent Number: 5,553,973

[45] Date of Patent: Sep. 10, 1996

[54] FLUMES FOR MANHOLE INVERTS

[76] Inventor: Lee Duran, 53 Mount Archer Rd., Lyme, Conn. 06371

[21] Appl. No.: 440,074

[22] Filed: May 12, 1995

[51] Int. Cl.[6] ..... E02B 9/04; F16L 5/00; F16L 41/00

[52] U.S. Cl. ..... 405/120; 405/121; 285/189

[58] Field of Search ..... 405/118, 119, 405/120, 121, 122; 73/215; 52/20, 21; 285/414, 410, 121, 127

[56] References Cited

U.S. PATENT DOCUMENTS

| | | | |
|---|---|---|---|
| 3,403,703 | 10/1968 | Reimann | 52/21 |
| 3,787,078 | 1/1974 | Williams | 285/189 |
| 4,095,466 | 6/1978 | Schontzler et al. | 73/215 |
| 4,253,282 | 3/1981 | Swartz | 52/20 |
| 4,341,236 | 7/1982 | LaBenz | 137/363 |
| 4,483,643 | 11/1984 | Gugemos | 405/154 |

*Primary Examiner*—Stephen J. Novosad

*Attorney, Agent, or Firm*—St. Onge Steward Johnston & Reens

[57] ABSTRACT

Flumes for manhole inverts are described and formed of integrally molded segments which interfit with each other so as to connect inlets to an outlet of a manhole independent of the shape and size of the manhole. The flumes are made in a set and in one set the flumes are formed of a pipe segment which either is integrally connected to an open channel segment or connected thereto with suitable fasteners and with the overall length of the flume being substantially less than the distance between the inlet and an outlet of the manhole. Another set of flumes has only open channel segments which are generally substantially smaller in length than the flumes which have both a pipe and an open channel segment. The open channel segments are provided with end flanges to enable their connection to similarly shaped channel segments to form inverts.

19 Claims, 6 Drawing Sheets

FIG. 1
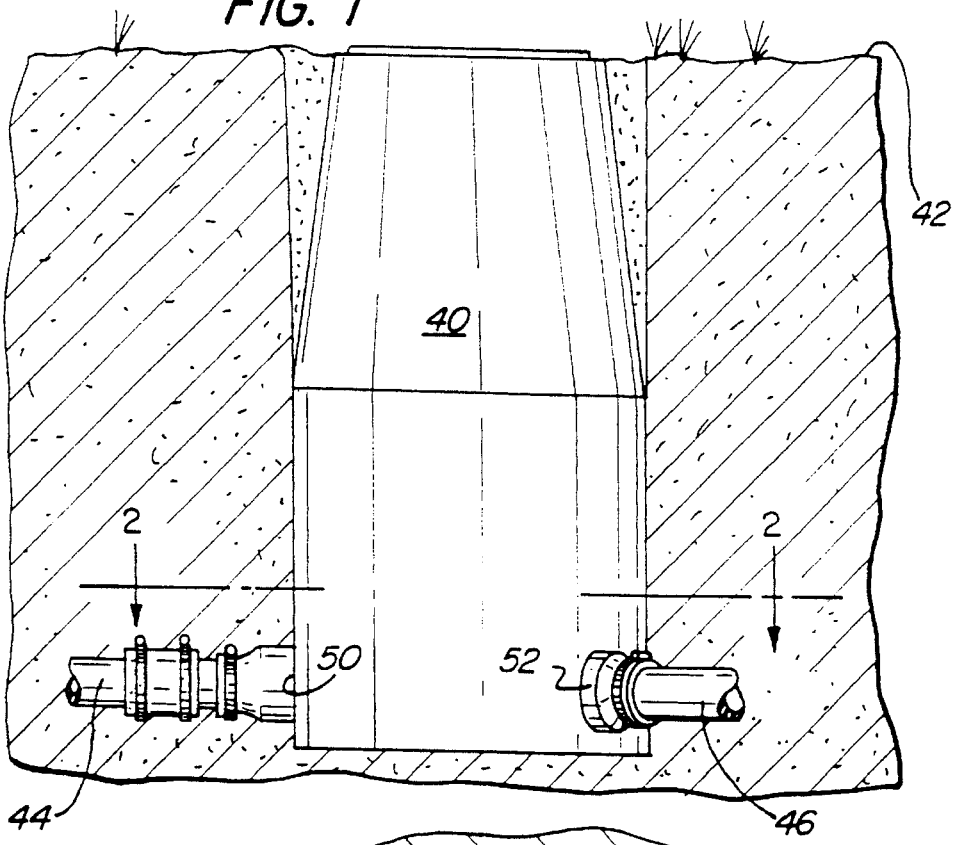
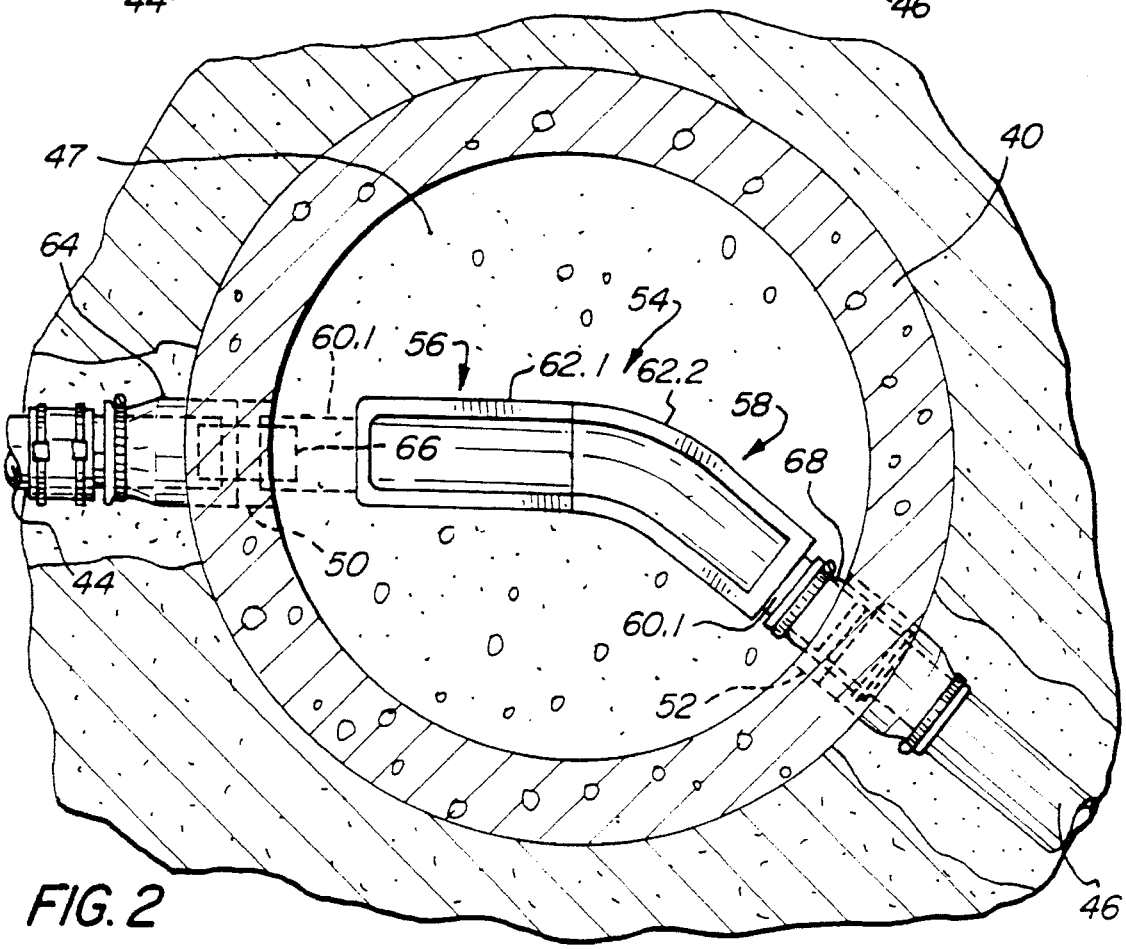
FIG. 2

62.1
56
60.1
72.2
72.1
76
62.2
74
71.1
71.2
70
60.1
71.3
58
72
72.1

76
60.2
70
60.1

60.1
76
70
56
74
72

72
60.1
56
70
62.1
74

FLUMES FOR MANHOLE INVERTS

FIELD OF THE INVENTION

This invention relates to manhole inverts generally and more specifically to a system of manhole inverts with which a well defined set of manhole invert modules can be employed to fit a large variety of different inlet and outlet configurations and differently sized manholes.

BACKGROUND OF THE INVENTION

In a typical manhole several sewer lines converge from different directions and the bottom of the manhole serves to provide a leak proof interconnection between the lines. The bottom of the manhole, however, is exposed to corrosive gases and liquids, which over time cause a deterioration of the bottom mortar sealings. These, therefore, begin to crumble and leak so that repairs need to be made. The repair has involved the insertion of a plastic invert supported by appropriate mortar, which in this case does not get exposed to the corrosives to the same extent. The use of plastic inverts has also been extended to new manhole constructions so as to extend their useful life.

Patents for plastic inverts have been described in the art, see for example U.S. Pat. Nos. 4,483,643 to Guggemos and 3,403,703 to Reimann. Other U.S. patents describing various ways for interconnecting sewerlines at the bottom of a manhole are U.S. Pat. Nos. 4,253,282 to Swartz, 3,7878,078 to Williams and 4,341,236 to LaBenz.

In these prior art inverts little room is available to adjust a preformed plastic invert to differently sized manholes while also accommodating sewer line connections from different directions. For example, the Reimann patent describes a preformed access channel of a fixed length which in effect requires building of the manhole around the invert to be placed at the bottom.

SUMMARY OF THE INVENTION

With inverts in accordance with the invention a great variety of interconnections independent from the size and shape of the manhole bottom can be conveniently made with a simplified inventory of flume parts. The invert is easily and quickly installed with a minimum of tools, has smooth flow characteristics and is easy to maintain.

This is achieved in accordance with one form of the invention by providing molded flumes of complementary shapes so that a multiple of these can be connected together in place at the bottom of a manhole to form an invert. The flumes have lengths substantially less than the distance between an inlet and an outlet of the manhole so that they can be interconnected in a variety of ways to form a continuous invert between them. The flumes in a set have different bends so that the inlet and outlet can be located at practically any angular position around the perimeter of the invert base of the manhole while still enabling the formation of a continuous invert. A flume connection can be made independent from the size and shape of the manhole bottom where the inlet and outlet are located.

The flumes are made of an impervious material, such as fiberglass, pvc or such other suitable plastic capable of providing high resistance to corrosion by the chemicals encountered in a sewer environment.

In one set of flumes of this invention a pipe segment and an open channel segment are either integrally joined or separate segments with the pipe segment straight and the channel segment either straight or curved. The curved channel segments can bend to the right or left and with different angles. For example in one set of flumes the open channel segments provide left and right channel bends in increments of 22½, 45, 67½, degrees to enable a broad range of angular connections. The set of flumes can be extended to include preshaped Y splits and a three way split to accommodate the interconnection of a multiple of inlets to the outlet of the manhole with a continuous invert. The set of flumes can be made more flexible with the use of flumes formed of short open curved and straight channel segments.

It is, therefore, an object of the invention to provide a flexible flume system with which a variety of manhole connections can be made with a limited inventory of flume parts. It is a further object of the invention to provide flumes for the interconnection of inlets and outlets of manholes independent of the size and shape of the manhole. It is a further object of the invention to provide a plurality of corrosion resistant and complementary fitting flumes which are convenient to retrofit into existing manholes to form long lasting inverts.

These and other objects and advantages of the invention can be understood from the following detailed description of flumes made in accordance with the invention as shown in the drawings.

BRIEF DESCRIPTION OF THE DRAWINGS

FIG. 1 is an elevation view of a typical manhole;

FIG. 2 is a horizontal section of the manhole taken along the line 2—2 in FIG. 1;

DETAILED DESCRIPTION OF THE DRAWINGS

Figures 3, 4, 5, 6, 7, 8:
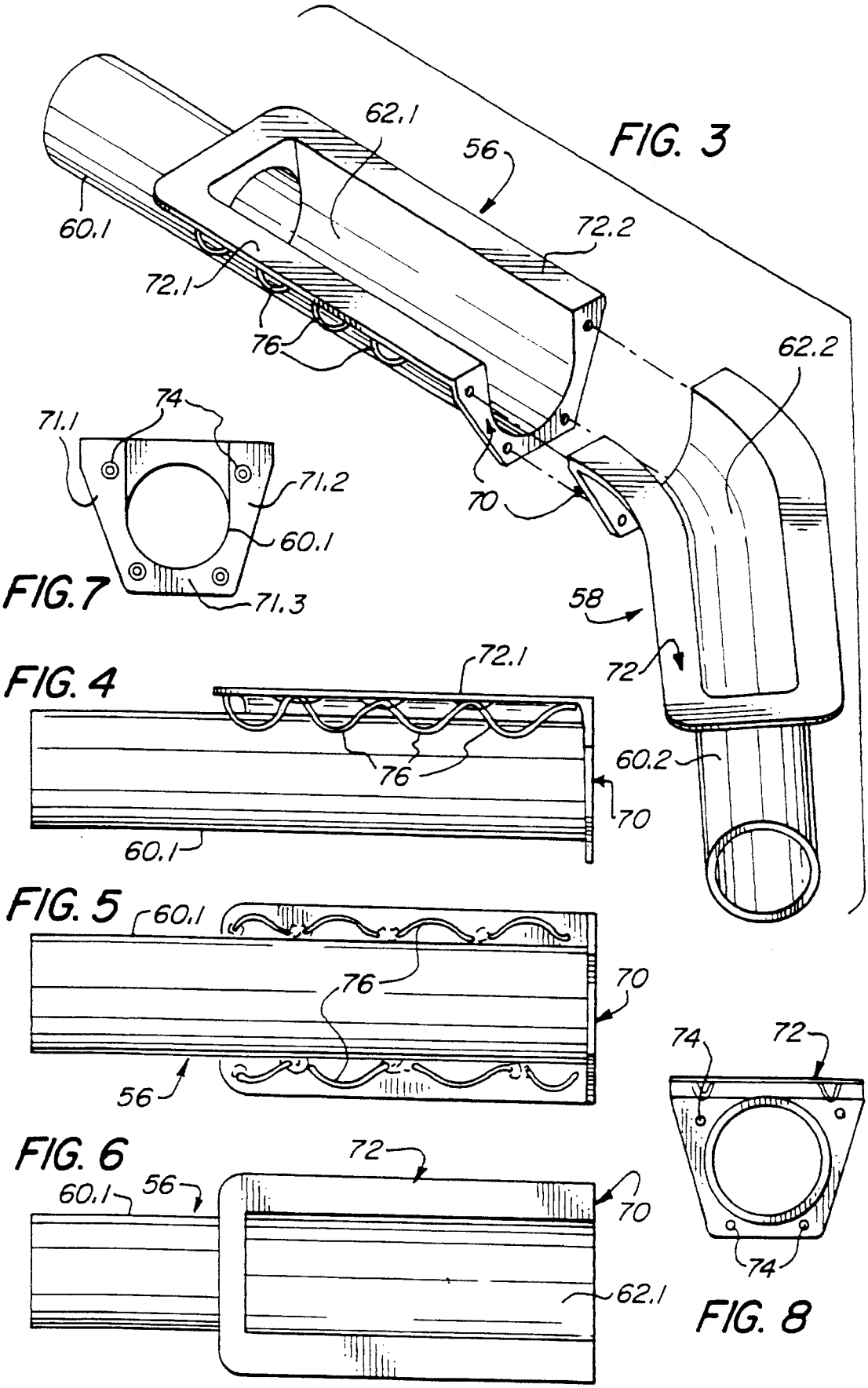
FIG. 3 is a perspective view of complementary fitting flumes in accordance with the invention.
FIG. 4 is a side view in elevation of a flume shown in FIG. 3.
FIG. 5 is a bottom view of the flume shown in FIG. 4.
FIG. 6 is top view of the flume shown in FIG. 4.
FIG. 7 is one end view in elevation of the flume shown in FIG. 4.
FIG. 8 is the other end view in elevation of the flume shown in FIG. 4.

With reference to FIGS. 1 and 2 a typical manhole 40 is shown extending from the surface 42 to below ground where a connection is to be made between an incoming sewer line 44 and an outgoing line 46 at the bottom 47 of the manhole. The manhole 40 is preformed of concrete or can be built in place and serves to enable the interconnection of the sewer lines and their maintenance.

The bottom 48 of the manhole 40 has appropriate inlet and outlet holes 50, 52 through which the sewer lines 44, 46 are to be interconnected with an invert 54. The invert can be made of stone and mortar as has been done in the past, but preferably is formed of a preformed plastic material that is impervious to the various materials flowing through the lines. When the invert is formed of a single continuous plastic material it is common to have the manhole made with the plastic invert already installed, such as with some of the prior art devices described in the art.

Figure 27:
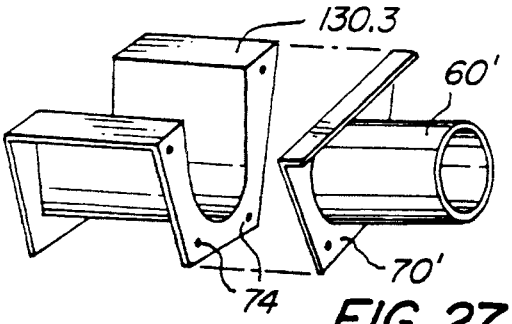
FIG. 27 is a perspective view of a flume in accordance with the invention and formed of separate channel and pipe segments.

With an invert 54 in accordance with the invention a connection between the sewer line inlet and outlet 50, 52 respectively is made with a pair of complementary fitting flumes 56, 58 each of which is substantially smaller in length than the invert distance between the inlet 50 and outlet 52. The flumes 56, 58 each are each formed with pipe segments 60.1, 60.2 and open channel segments 62.1, 62.2 of preferably like cross-section. Alternatively and as shown in FIG. 27 the flumes 56, 58 can be formed by joining an open channel segment 62 to a separate pipe segment 60. This type of construction is particularly desirable when the flume is so large and heavy that it is hard to handle in a manhole environment.

The flume 58 has a curved open channel segment 62.2 and of the same cross-sectional shape and size as channel segment 62.1 to enable an abutting fit with each other. The angle formed by the curved channel segment 62.1 is of a predetermined size available from a set of flumes so as to form a continuous invert between the inlet and outlet 50, 52. The flumes 56, 58 are either made of integrally molded plastic material such as fiberglass or other suitable plastic or made of separate individually molded pipe and channel segments which are joined together.

The flumes 56, 58 can advantageously be placed into an already installed manhole as a retrofit. In such case the flumes pipe segments 60.1 and 60.2 are connected to the incoming and outgoing lines 44, 46 with suitable conventional couplers 64, 66, 68 made with clamped rubber sections. The couplers form appropriate seals such as with the walls of the inlet and outlet holes 50, 52 for couplers 64 and with internal walls of pipe segments 60.1, 60.2 for coupler 66 and with the outside surfaces of the pipe segments for coupler 68.

Figure 11:
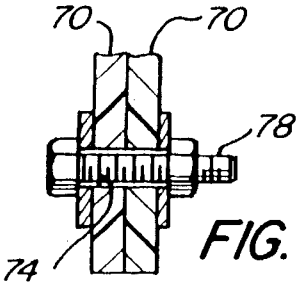
FIG. 11 is an enlarged section view of a flange connection between different flumes.

As shown in FIGS. 3 through 8 the flumes 56, 58 have open channel segments 62.1 and 62.1 having vertically oriented end flanges 70 and top flanges 72. The end flanges 70 are formed of side flange segments 71.1 and 71.2 which are integrally connected to horizontal flanges 72.1 and 72.2 and a lower vertical flange segment 71.3. Vertical flanges 70 flush fit with each other and are so aligned during installation and then drilled to form the mounting holes 74 for bolts 78 as shown in FIG. 11. Other fasteners can be used to hold flanges of different flumes together.

A suitable bead of caulking compound, such as silicone, butyl or moisture cured urethane, is placed on the vertical flanges prior to connection to provide a sealed connection. The top horizontal flanges 72 are provided with embedded retainer elements 76 in the form of loops to enable anchoring to surrounding mortar. Other types of anchoring elements can be used. The pipe segments 60.1 and 60.2 smoothly mesh with the open channel segments so as to minimize obstructions.

Figure 9:
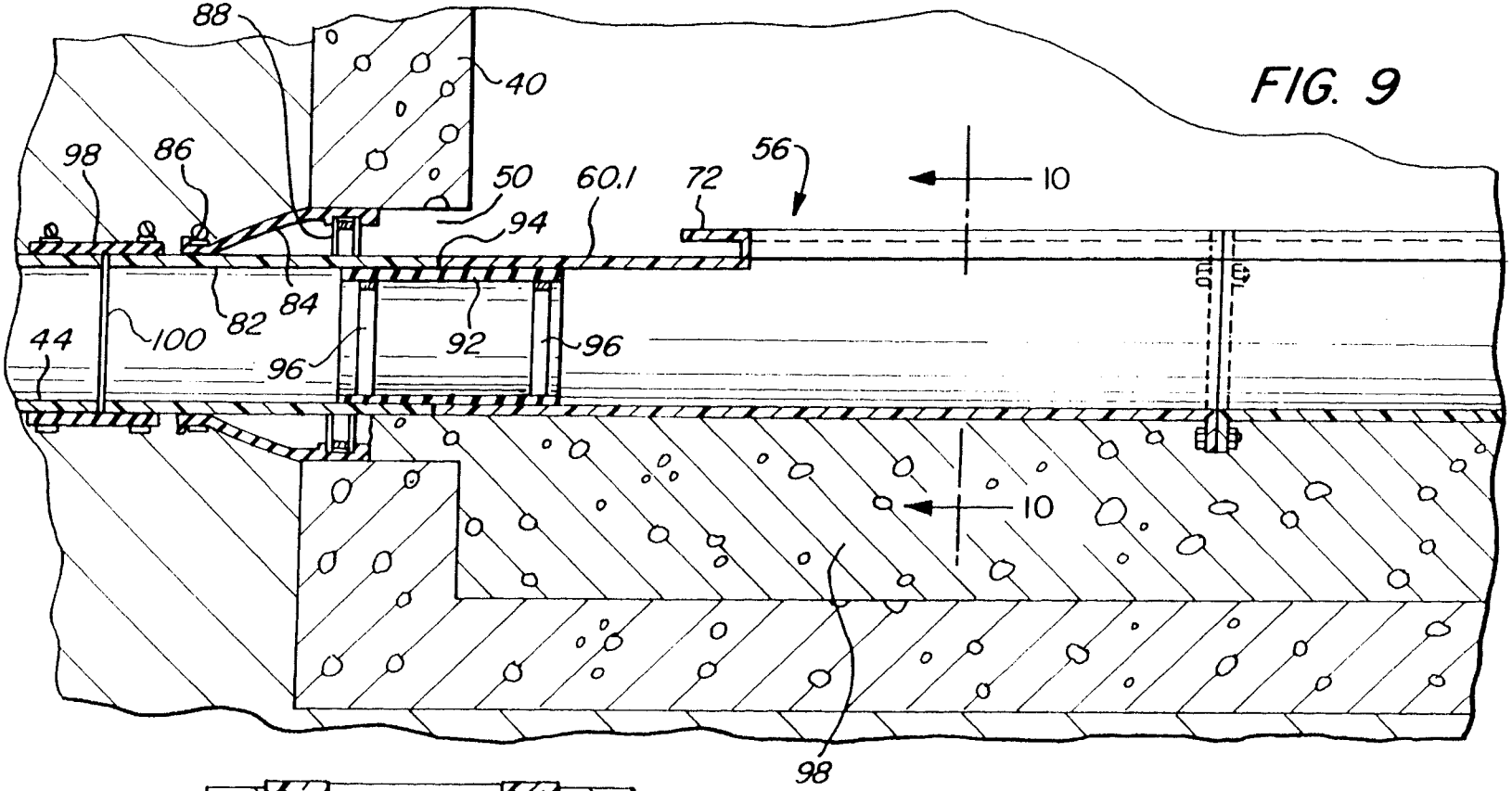
FIG. 9 is a partial section view of a port connection made using flumes in accordance with the invention.
Figure 10:
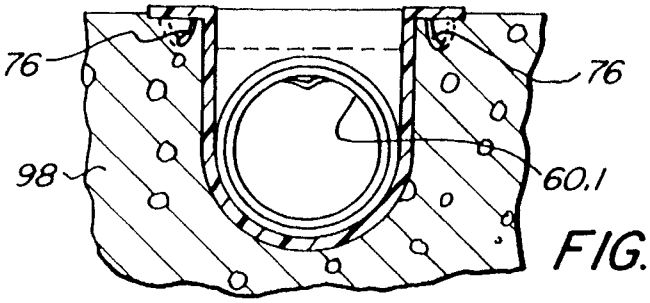
FIG. 10 is a vertical section view taken along the line 25—25 in FIG. 24.
Figure 12A:
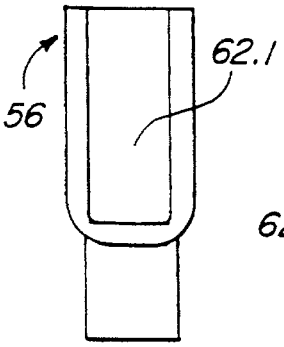
FIGS. 12A through 12H are top views of a set of different flumes used to form inverts in manholes.
Figure 12B:
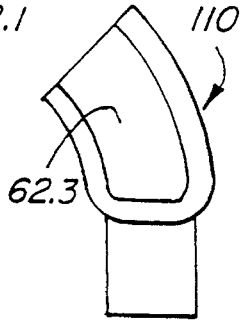
Figure 12C:
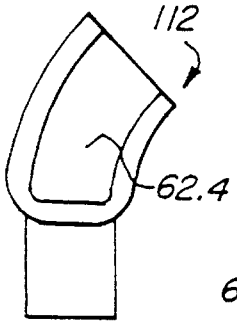
Figure 12D:
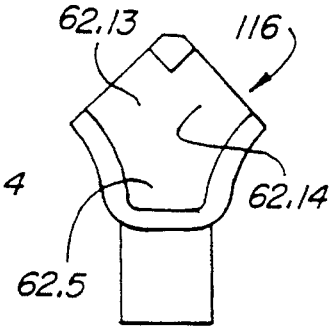
Figure 12E:
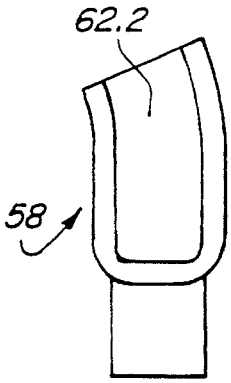
Figure 12F:
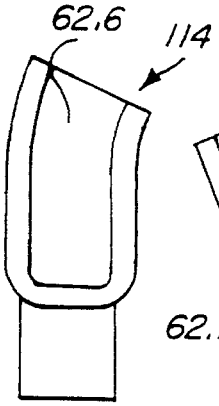
Figure 12G:
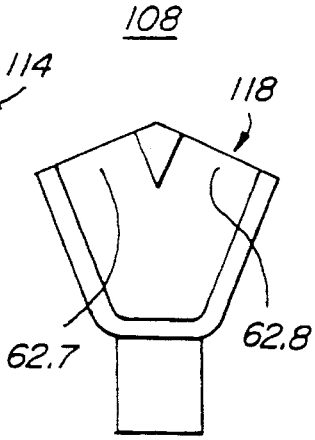
Figure 12H:
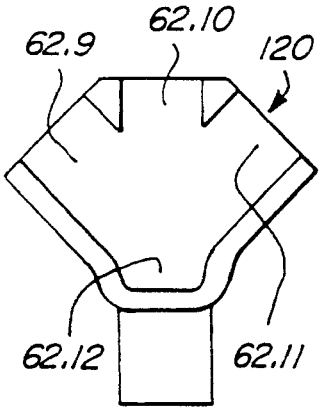

The connection of flumes such as 56 to a sewer line is illustrated in FIGS. 9 through 11. The pipe segment 60.1 of flume 56 is shown in abutment with the sewer line 44 by way of an intermediate pipe section 82. The latter pipe section 82 in turn is in abutment with the main sewer pipe line 44. The intermediate pipe section 82 is not always needed, and is shown herein for illustration purposes. The intermediate pipe section, or the main sewer pipe line 44 is connected to the wall of the inlet 50 by way of a sealing coupler 84 such as may be obtained from the NPC Inc. of Milford, N.H. as its flexible pipe-to-manhole connector. This coupler employs a typical pipe clamp 86 and an expansion clamp 88 for clamping the connector 84 to the wall 90 of inlet 50.

Note that the pipe segments 60 are preferably made somewhat longer so that during installation, pipe length adjustments can made to enable the flumes to fit within manholes 40 and abut with the ends of sewer lines. This approach is particularly suitable when a pipe segment 60' as shown in FIG. 27 can be individually handled and then subsequently connected to an open channel segment such as 130.3 or a channel segment 62 with its own vertical flange 70'.

Internal flexible seals 92 are placed inside the pipe sections 60.1, 82 across their junction 94 and clamped to the internal surfaces with internal expansion clamps 96. These seals can also be obtained from the NPC Inc. An external flexible annular seal 98 is placed around the junction 100 between the sewer line 44 and the intermediate pipe section 82 and affixed with suitable stainless steel hose clamps 102.

The flumes 56, 58 after alignment and sealing connections to the manhole 40 and sewer lines 44 and 46 are imbedded in cement 98 generally to a level sufficient to cover the retainer elements 76 and the top surface of the flanges 72 so as to enable fluids on the side located cement to flow into the flumes. The anchoring elements 72 can be made of steel or formed of the base material used to make the flumes 56, 58 so as to simplify their attachment to the flumes.

A particular advantage of the invention is the ability to accommodate various invert designs as these are needed depending upon the arrangement of the inlets and outlet to the manhole 40. Hence, another aspect of the invention is that a set of flumes is produced with which a large range of interconnections can be made while keeping the inventory of individual flume parts to a reasonable level. This aspect can be appreciated with reference to FIGS. 12 through 26.

Thus as illustrated in FIGS. 12A–12H a set 108 of flumes 56, 58 and 110 through 120 is shown. In the set 108 each flume has a straight pipe segment 60 and either a curved or straight open channel segment 62. It is to be understood that the flumes can be formed from individual pipe and channel segments that can be connected together with bolts in situ in the manner as shown in FIG. 11 or can be joined as an integrally structure as illustrated in FIGS. 3–8.

The flumes in the set 108 assemble into inverts with different orientations depending upon which flumes are connected together. The flumes 110, 112 provide each 45° bent channel segments 62. The flumes 58, 114 have channel segments which provide bends of 22½°. The FIGS. 14 through 22 illustrate various inverts 122 that can be formed with the flumes of the set 108. Similar, but left turning inverts 122 can be formed by inverting the position of the flumes. For example, when the flumes 54, 56 are reversed there is a bend of about 22 degrees to the left instead of about 22 degrees to the right.

Figure 13:
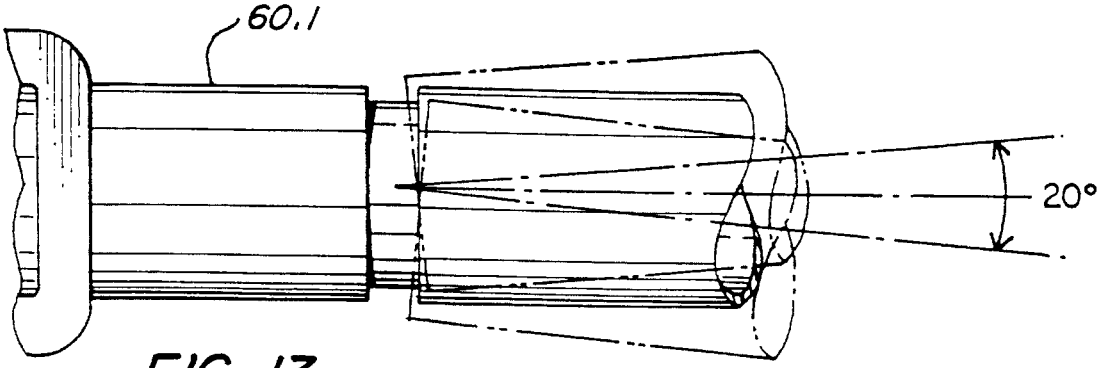
FIG. 13 is a top view of various fits of a flume to a port of a manhole.
Figures 14, 15, 16, 17, 18, 19:
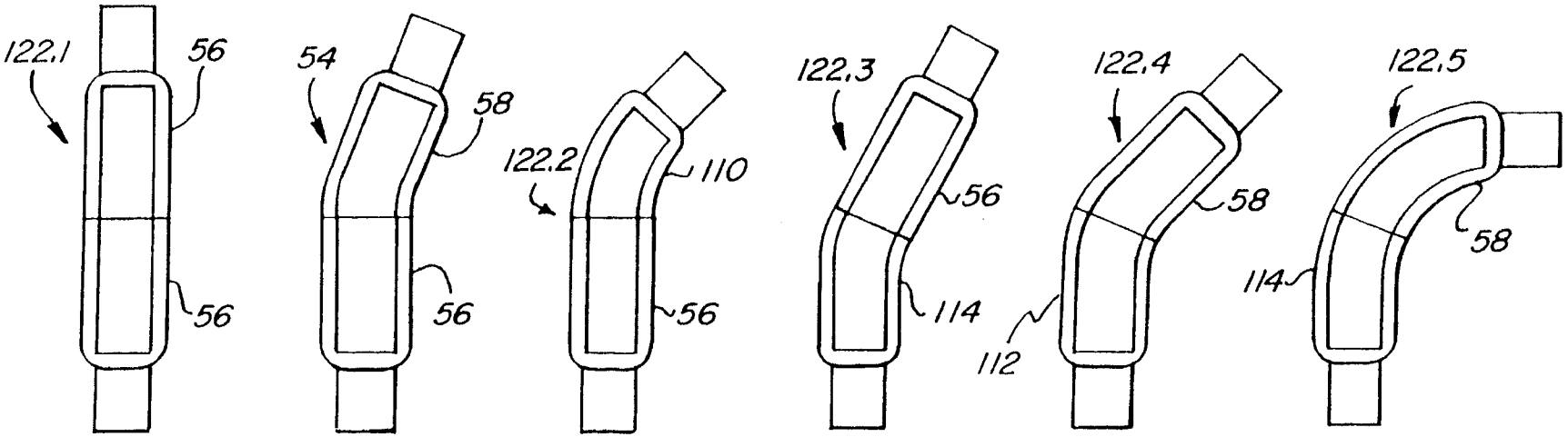
FIGS. 14 through 22 are top schematic views of inverts that can be made using flumes shown in the set of FIGS. 3A–3H.
Figure 22A:
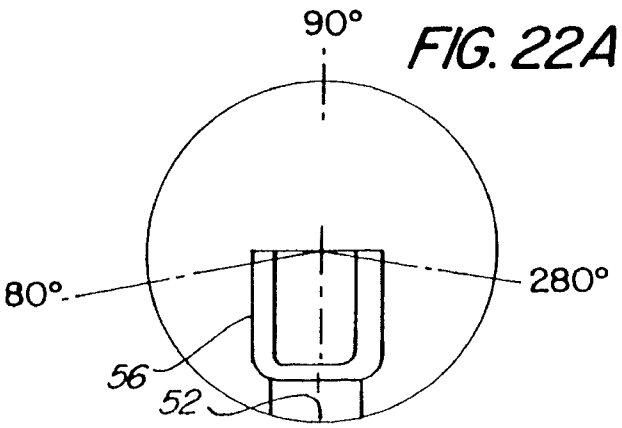
FIG. 22A is a schematic representation of angular connections that can be made with flumes in accordance with the invention.
Figures 20, 21, 22:
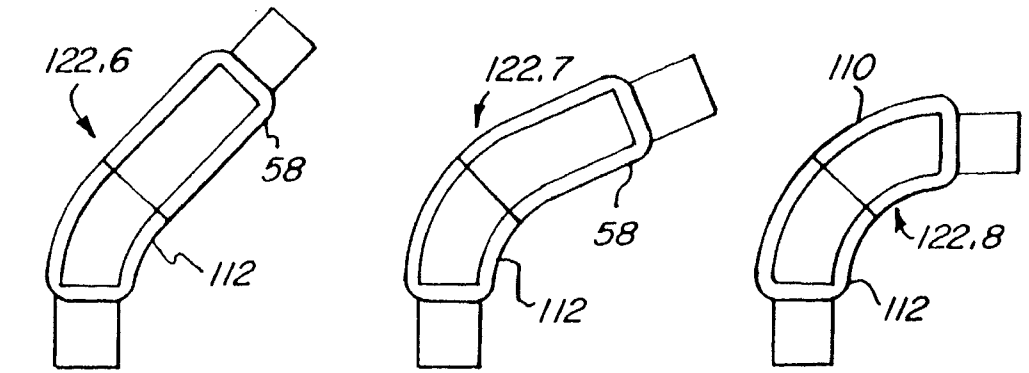
Figure 23:
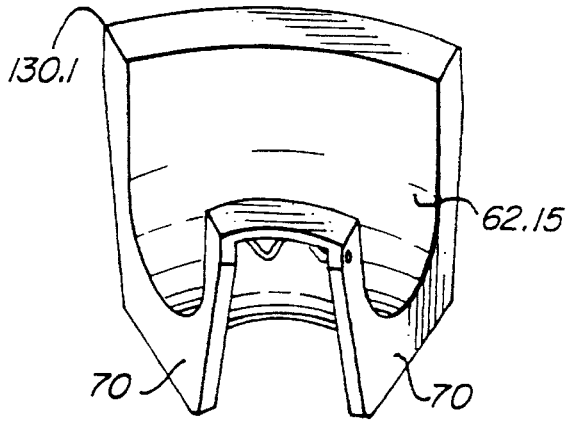
FIGS. 23 through 25 are perspective views of modular flumes made of open channel segments for use with the set of flumes shown in FIGS. 12A–12H.
Figure 24:
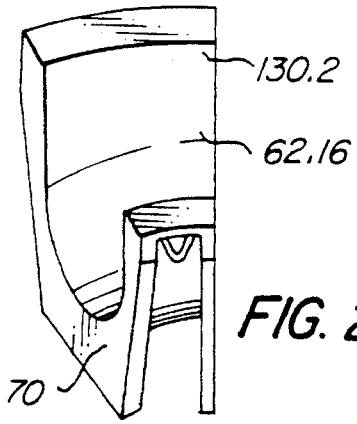
Figure 25:
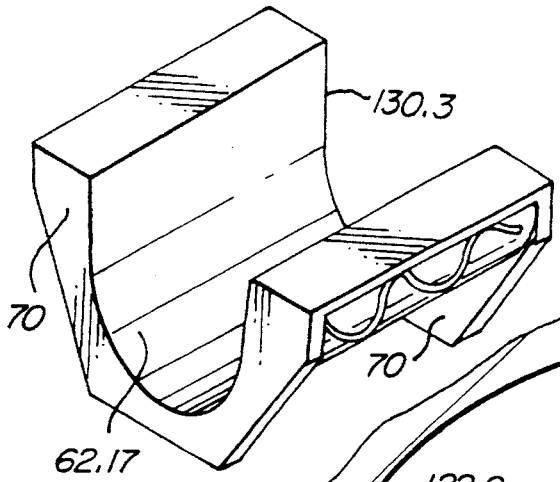

FIG. 13 shows an angular adjustability of a flume with respect to the inlet or outlet to which it is connected. The use of flexible couplings such as 84 enables one to angle the entry of the pipe section 60 of a flume into an inlet 50 or outlet 52 over a range of about +/−10°. As a result a continuous angular range of bends can be accommodated with the set of flumes shown in FIGS. 12A–12H extending from about 80° to about 280° relative to an outlet 52 for example as illustrated in the FIG. 22A.

The amount of bend in an invert is thus dependent upon which of the various flumes are connected together. If sufficient space or distance is available between the inlet 50 and an outlet 52 in a manhole the bends can be made larger. When the set of flumes includes other flumes 130, shown in FIGS. 23–25, and which mesh with the channel segments 62 complex inverts can be formed inside the manhole 40. By employing flumes formed with separate pipe and channel segments the choice of invert shapes is greatly enlarged.

Flumes 130 have small open channel segments 62 and fit in the available space of manhole 40. Flumes 130 do not have pipe segments 60. Flume 130.1 has a channel segment which provides a bend of 45°, flume 130.2's channel segment 62.16 provides a bend of 22½° and flume 130.3 has a straight channel segment 62.17. Since the flumes have longitudinal symmetry they can be reversed and used to make left or right bends. Each of the flumes 130 terminate with an end flange 70 enabling their connection to the end flange 70 of another flume. The overall lengths of the flumes 130 are substantially less than the lengths of flumes such as shown in FIGS. 12A–12H, though from time to time a longer flume 130 can be made with flanges 70 at ends of its open channel.

Figure 26:
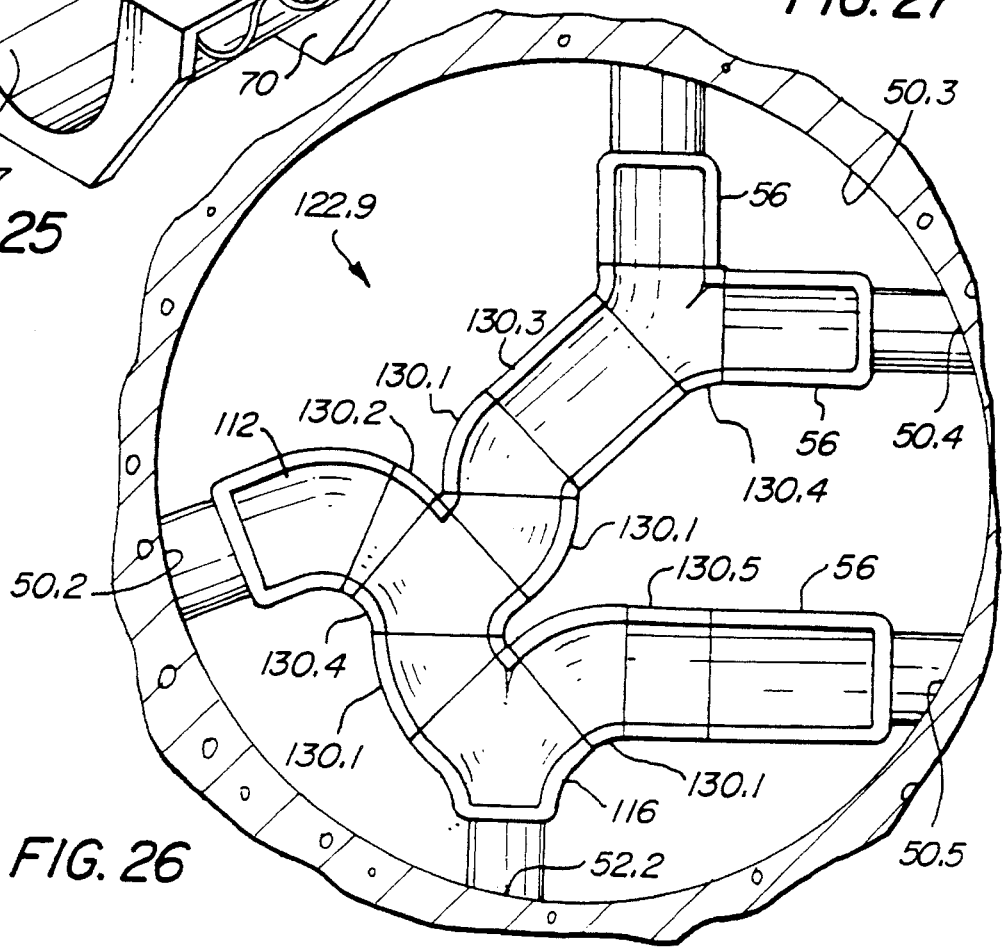
FIG. 26 is a top schematic view of port connections made in a manhole with flumes shown in FIGS. 23–25 and FIGS. 3A–3H.

FIG. 26 illustrate an invert 122.9 formed of a plurality of flumes selected from those shown in the Figures and addition channel segments shaped flumes such as 130.4, and 130.5. The invert 122.9 has four inlets 50.2–50.5 connected to deliver through gravity feed their liquid contents to a common outlet 52.2. The various channel segments 62 of the different flumes are connected together in place in the manner as described with reference to FIG. 9.

In FIG. 27 a separated pipe segment is shown formed of a vertical flange 70' and a pipe 60'. The vertical flange 70' is connectable within a manhole by using bolt fasteners after holes 74 have been drilled. The pipe segment 60' can be joined to anyone of the openchannel segments 130 or 62 shown in the Figures.

Having thus described various flumes made in accordance with the invention its advantages can be appreciated. Different inverts can be made to fit field conditions and a great variety of manhole shapes and sizes can be accommodated from a relatively inexpensive set of flumes of like cross-section held in inventory. Use and installation of the inverts is simple and convenient under most severe field conditions.

Different forms of the invention can, therefore, be made from those show and described in the specification without departing from the scope and spirit of the invention, which is to be determined from the following claims.

What is claimed is:

1. A flume for an invert for a manhole having a base along which a flume path connects an inlet at the manhole base to an outlet at the manhole base, comprising:

a first flume having a pipe segment and an open channel segment in fluid communication with said pipe segment; said pipe segment and said open channel segment having an overall length that is substantially smaller than the distance between said inlet and outlet as measured along said flume path;

a second flume having an open channel segment and a pipe segment in fluid flow communication with said latter open channel segment, and with the overall length of said second flume being substantially less than said distance between said inlet and outlet ports along said flume path;

the open channel segment of the second flume having a like cross-segment as said channel segment of the first flume;

said second flume having a complementary cross-sectional shape with respect to said first flume so as to form a continuous invert between said inlet and outlet at the base of said manhole when the channel segments of said first and second flumes are in abutment with each other.

2. The flume for an invert as claimed in claim 1 wherein said pipe and open channel segments are separate segments, and means for joining said segments to form said flume.

3. The flume for an invert as claimed in claim 1 and further including a third flume having a channel segment with a cross-sectional shape that is the same as that of the channel segments of said first and second flumes; said third flume having a cross-sectional shape that is complementary with that of the first and second flumes and end flanges so as to fit in abutment with the channel segments thereof and enable the formation of a continuous invert therewith between the inlet and outlet ports at the base of the manhole.

4. The flume for an invert as claimed in claim 1 wherein said channel segments of said first and second flumes have vertically oriented similarly shaped flanges which fit against each other so as to form a generally flush abutting engagement.

5. A flume for an invert for a manhole having a base along which a flume path connects an inlet at the manhole base to an outlet at the manhole base, comprising:

a first integral flume having a pipe segment and an open channel segment in fluid communication with said pipe segment; said pipe segment and said channel segment having an overall length that is substantially smaller than the distance between said inlet and outlet as measured along said flume path;

a second integral flume having an open channel segment and a pipe segment in fluid flow communication with said latter open channel segment, and with the overall length of said second flume being substantially less than said distance between said inlet and outlet ports along said flume path;

the open channel segment of the second flume having a like cross-section as said open channel segment of the first flume;

said second flume having an open channel segment which has a cross-section that is complementary shaped with respect to the open channel segment of said first flume so as to enable the formation of a continuous invert between said inlet and outlet at the base of said manhole when the open channel segments of said first and second flumes are in abutment with each other.

6. The flume for an invert as claimed in claim 5 and further including a third flume formed of an open channel segment having a cross-section that is the same as that of the open channel segments of the first and second flumes.

7. The flume for an invert as claimed in claim 6 wherein said first, second and third flumes have vertically oriented shaped flanges shaped to fit in abutment with each other; and means for selectively connecting vertically oriented flanges of the first, second and third flumes together to form an invert.

8. The flume for an invert as claimed in claim 6 wherein said first, second and third flumes have horizontal flanges at upper ends of their open channel segments and anchoring elements depending from the horizontal flange segments.

9. Invert forming flumes for a manhole having a base along which a flume path connects an inlet to an outlet at the manhole base, comprising:

a first set of flumes having integrally molded pipe segments and open channel segments, with the open channel segments having like cross-sections;

selected flumes having straight open channel segments and selected flumes having curved open channel segments so as to impart a change of direction relative to the integrally connected pipe segments;

said flumes being interconnectable at ends of said open channel segments to form a multiple flume part connection between the inlet and outlet of the manhole.

10. The invert forming flumes as claimed in claim 9 and further including a second set of flumes formed of open channel segments having substantially similar cross-sections as those of the open channel segments of the first set of flumes, said second set of flumes having vertical flanges at ends of the open channel segments.

11. The invert forming flumes as claimed in claim 10 wherein the second set of flumes have lengths which are generally substantially smaller than the overall lengths of the flumes in the first set.

12. The invert forming flumes as claimed in claim 11 wherein selected flumes in the second set have straight and curved open channel segments.

13. The invert forming flumes as claimed in claim 12 wherein selected flumes in the second set have bends with angles of about 22.5 and 45 degrees.

14. The invert forming flumes as claimed in claim 9 wherein selected open channel segments are curved to present effective bends at angles of about 22.5, and 45 degrees and bent to the left and to the right.

15. A flume for an invert for a manhole having a base along which a flume path connects an inlet at the manhole base to an outlet at the manhole base, comprising:

a first pipe segment and a first open channel segment sized for fluid communication with said first pipe segment; said first pipe segment and said first open channel segment having an overall combined length that is substantially smaller than the distance between said inlet and outlet as measured along said flume path;

a second pipe segment sized for fluid flow communication with said first open channel segment, and with the overall combined length of said first open channel segment and said second pipe segment being substantially less than said distance between said inlet and outlet ports along said flume path;

the first open channel and pipe segments having like cross-sections so as to form a continuous invert between said inlet and outlet at the base of said manhole when the first open channel and pipe segments are in abutment with each other.

16. The flume as claimed in claim 15 wherein said first open channel segment has flanges at the end thereof and said pipe segments have end flanges sized to fit in abutment with the flanges of said open channel segment.

17. The flume as claimed in claim 15 and further including means for retaining said segment in abutment with each other so as to form a continuous flume between the inlet and outlet ports.

18. A flume for an invert for a manhole having a base along which a flume path connects an inlet at the manhole base to an outlet at the manhole base, comprising:

a first open channel segment and a second open channel segment sized for fluid communication with said first open channel segment; each of said open channel segments having an overall length that is smaller than the distance between said inlet and outlet as measured along said flume path;

said open channel segments having end located flanges to enable their abutment connection to each other, with said first and second open channel segments having like cross-sections so as to form a continuous invert between said inlet and outlet at the base of said manhole when the first and second open channel segments are in abutment with each other.

19. The flume as claimed in claim 18 wherein said open channel segments each have a flange at respective ends thereof for connection to a similar flange of another open channel segment and to pipes emerging from the inlet and outlet at the base of the manhole.

* * * * *